US010971868B2

(12) United States Patent
Yi et al.

(10) Patent No.: US 10,971,868 B2
(45) Date of Patent: Apr. 6, 2021

(54) ELECTRICAL/MECHANICAL SWITCHING MODULE

(71) Applicant: TE CONNECTIVITY SERVICES GMBH, Schaffhausen (CH)

(72) Inventors: Chong Hun Yi, Mechanicsburg, PA (US); Brian Keith Weaver, Harrisburg, PA (US); William James Moyer, II, Selinsgrove, PA (US); Divya H. Shukla, Harrisburg, PA (US); James Doucette, Nashville, TN (US)

(73) Assignee: TE Connectivity Services GmbH, Schaffhausen (CH)

( * ) Notice: Subject to any disclaimer, the term of this patent is extended or adjusted under 35 U.S.C. 154(b) by 0 days.

(21) Appl. No.: 16/782,146

(22) Filed: Feb. 5, 2020

(65) Prior Publication Data

US 2020/0266588 A1 Aug. 20, 2020

Related U.S. Application Data

(60) Provisional application No. 62/807,943, filed on Feb. 20, 2019.

(51) Int. Cl.

| | |
|---|---|
| ***H01R 29/00*** | (2006.01) |
| ***H01R 13/703*** | (2006.01) |
| ***H01R 13/50*** | (2006.01) |

(52) U.S. Cl.

CPC ..... *H01R 13/7036* (2013.01); *H01R 13/50* (2013.01)

(58) Field of Classification Search

CPC ..... H01R 13/50; H01R 13/70; H01R 13/703; H01R 13/7036; H01R 13/7037; H01R 13/7038

USPC ..... 439/188, 660; 200/51 R, 51.09

See application file for complete search history.

(56) References Cited

U.S. PATENT DOCUMENTS 3,913,054 A * 10/1975 Wolfe ..... H01H 37/68 337/362
4,179,175 A * 12/1979 Farnworth ..... H01R 13/7036 200/51.09
4,190,751 A * 2/1980 Roth ..... H01H 5/20 200/468
4,283,102 A * 8/1981 Richier ..... H01R 13/7036 439/140
4,516,819 A * 5/1985 Le Magourou .... H01R 13/7036 439/180

(Continued)

*Primary Examiner* — Khiem M Nguyen

(57) ABSTRACT

An electrical/mechanical switching having a first terminal and a second terminal. The first terminal is a neutral terminal and has a first terminal power engagement tab and a first terminal engagement tab with a first terminal copper dimple. The second terminal is a neutral terminal and has a second terminal mating engagement tab and a second terminal engagement tab with a second terminal copper dimple. A cam member is provided proximate the first terminal engagement tab and is movable between a first position and a second position to move the first terminal engagement tab into electrical and mechanical engagement with the second terminal engagement tab. An opening projection is provided proximate the first terminal engagement tab and the second terminal engagement tab and is movable between a first position and a second position to separate the first terminal engagement tab and the second terminal engagement tab.

20 Claims, 3 Drawing Sheets

(56) References Cited

U.S. PATENT DOCUMENTS 4,707,042 A * 11/1987 Haden ..... H01R 13/7036
439/140

* cited by examiner

ELECTRICAL/MECHANICAL SWITCHING MODULE

FIELD OF THE INVENTION

The present invention is directed to an electrical/mechanical switching module for use in an electrical connector assembly. In particular, the invention is directed to a switching module with mechanical switching for use in applications where high current load is required.

BACKGROUND OF THE INVENTION

In order to safely control the delivery of high current, electrical switching devices must be provided with separate mechanical switches. However, the inclusion of the additional mechanical switches increases the cost and complexity of the switching device.

It would be, therefore, beneficial to provide an electrical connector which does not require a separate mechanical switch or an internal spring, but which includes an integral electrical/mechanical switching module, thereby simplifying the connector and reducing the cost of the connector. It would also be beneficial to provide such an electrical/mechanical switching module in which the flow of the electrical current is only permitted when the connector is fully mated, thereby increasing the safety of the module and the connector.

SUMMARY OF THE INVENTION

An embodiment is directed to an electrical/mechanical switching module having a housing with a front face, a rear face, a top wall, bottom wall and side walls extend from the front face to the rear face. Terminals are provided in the housing. A first terminal of the terminals is a hot terminal and has a first terminal power engagement tab, a first terminal engagement tab and a first terminal mounting portion. A second terminal of the terminals is a hot terminal and has a second terminal power engagement tab, a second terminal engagement tab and a second terminal mounting portion. A third terminal of the terminals is a ground terminal and has a third terminal power engagement tab, a third terminal engagement tab and a third terminal mounting portion. A fourth terminal of the terminals is a neutral terminal and has a fourth terminal power engagement tab, a fourth terminal engagement tab and a fourth terminal mounting portion. A fifth terminal of the terminals is a neutral terminal and has a fifth terminal engagement tab, a fifth terminal engagement tab and a fifth terminal mounting portion.

An embodiment is directed to an electrical/mechanical switching module having a housing having a front face, a rear face, a top wall, bottom wall and side walls extend from the front face to the rear face. A first terminal is positioned in the housing. The first terminal is a neutral terminal and has a first terminal power engagement tab, a first terminal engagement tab and a first terminal mounting portion. The first terminal power engagement tab extends from a side wall of the side walls of the housing. The first terminal engagement tab extends from the top wall of the housing. A second terminal is positioned in the housing. The second terminal is a neutral terminal and has a second terminal engagement tab, a second terminal engagement tab and a second terminal mounting portion. The second terminal engagement tab extends from the top wall of the housing. The second terminal engagement tab extends from the bottom wall of the housing. With the electrical/mechanical switching module in an open position, the first terminal is in an unstressed position and the first terminal engagement tab is spaced from the second terminal engagement tab. In the open position, neither a mechanical or electrical connection is made between the first terminal engagement tab and the second terminal engagement tab preventing electrical current from flowing across the first terminal engagement tab and the second terminal engagement tab. With the electrical/mechanical switching module is in a closed position, the first terminal is moved to a stressed position and the first terminal engagement tab is moved into engagement with the second terminal engagement tab. In the closed position, a mechanical and electrical connection is made between the first terminal engagement tab and the second terminal engagement tab allowing electrical current to flow across the first terminal engagement tab and the second terminal engagement tab.

An embodiment is directed to an electrical/mechanical switching having a housing. A first terminal is provided in the housing and is a neutral terminal. The first terminal has a first terminal power engagement tab, a first terminal engagement tab and a first terminal mounting portion. A second terminal is provided in the housing and is a neutral terminal. The second terminal has a second terminal engagement tab, a second terminal engagement tab and a second terminal mounting portion. A cam member is provided proximate the first terminal engagement tab of the first terminal. The cam member is movable between a first position and a second position to move the first terminal engagement tab into electrical and mechanical engagement with the second terminal engagement tab. An opening projection is provided proximate the first terminal engagement tab of the first terminal and the second terminal engagement tab of the second terminal. The opening projection is movable between a first position and a second position to separate the first terminal engagement tab and the second terminal engagement tab.

An embodiment is directed to an electrical/mechanical switching having a housing. A first terminal is provided in the housing. The first terminal is a neutral terminal and has a first terminal power engagement tab and a first terminal engagement tab. The first terminal engagement tab is movable between an open position and a closed position. A second terminal is provided in the housing. The second terminal is a neutral terminal and has a second terminal engagement tab and a second terminal mating engagement tab. The first terminal has a first terminal copper dimple attached to the first terminal engagement tab and the second terminal having a second terminal copper dimple attached to the second terminal engagement tab. The first terminal copper dimple is spaced from the second terminal copper dimple copper dimple when the first terminal engagement tab is in the open position. The first terminal copper engages the second terminal copper dimple copper dimple when the first terminal engagement tab is in the closed position allowing electrical current to flow from the first terminal copper dimple to the second terminal copper dimple.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
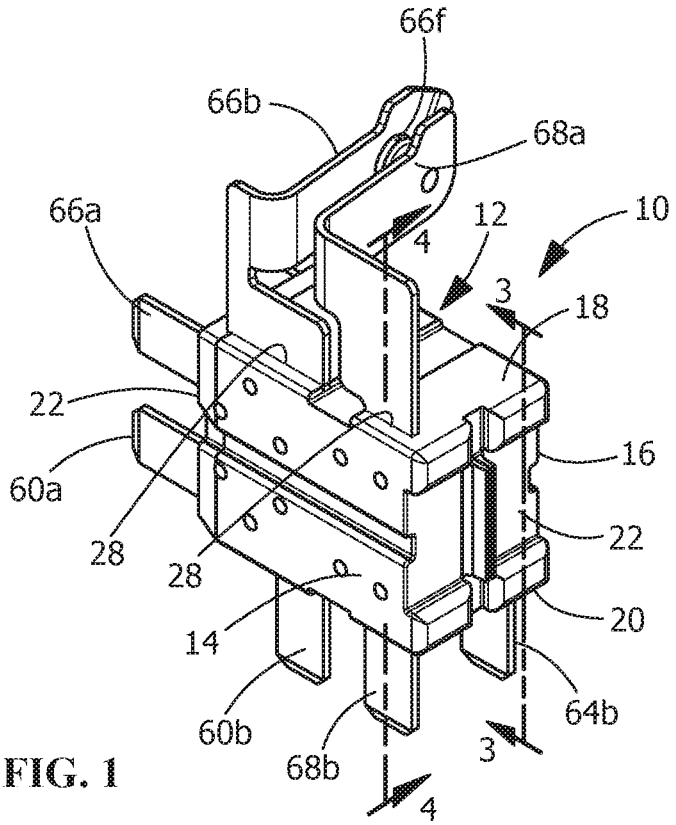
FIG. 1 is a front perspective view of an illustrative electrical/mechanical switching module of the present invention for use in an electrical connector assembly, the electrical/mechanical switching module is shown in a first or open position.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments. Accordingly, the invention expressly should not be limited to such embodiments illustrating some possible non-limiting combination of features that may exist alone or in other combinations of features, the scope of the invention being defined by the claims appended hereto.

Figure 2:
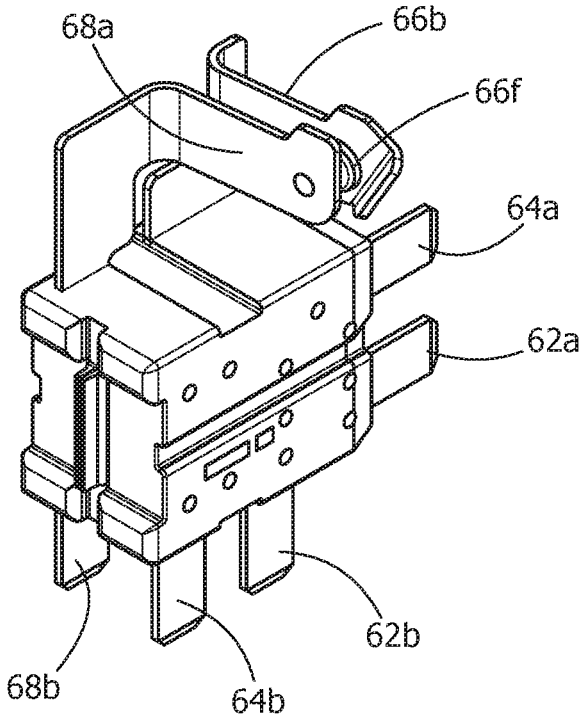
FIG. 2 is a back perspective view of the illustrative electrical/mechanical switching module of FIG. 1, the electrical/mechanical switching module shown in the first or open position.

Referring to FIGS. 1 and 2, the electrical/mechanical switching module 10 has a housing 12 with a front face 14 and a rear face 16. Top wall 18, bottom wall 20 and side walls 22 extend from the front face 14 to the rear face 16. The housing 12 is configured to be mounted in an electrical connector assembly or in machinery.

Figure 3:
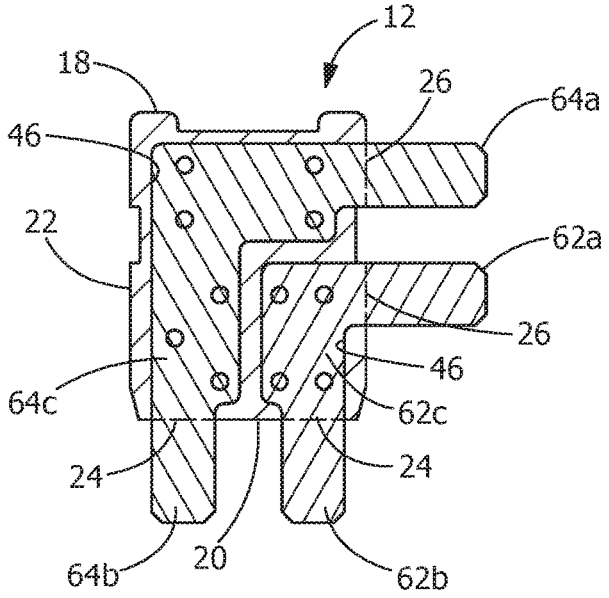
FIG. 3 is a cross-sectional view taken along line 3-3 of FIG. 1.
Figure 4:
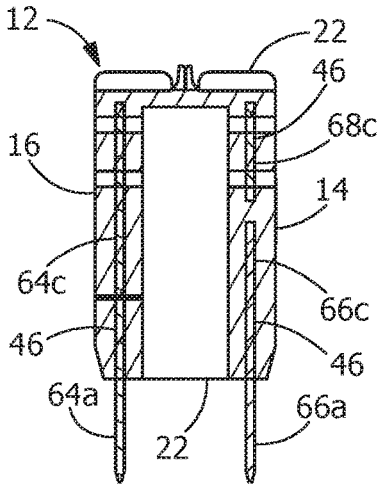
FIG. 4 is a cross-sectional view taken along line 4-4 of FIG. 1.

In the embodiment shown, four tab receiving openings 24 (shown in FIG. 3) extend through the bottom wall 20 of the electrical/mechanical switching module 10. Four tab receiving openings 26 (shown in FIG. 3) extend through a side wall 22. Two tab receiving openings 28 extend through the top wall 18 of the electrical/mechanical switching module 10.

As best shown in FIGS. 1 through 5, terminals 60, 62, 64, 66, 68 are provided in the electrical/mechanical switching module 10. Terminal 60 is a hot terminal and has a power engagement tab 60*a*, a mating engagement tab 60*b* and a mounting portion 60*c*. Terminal 62 is a hot terminal and has a power engagement tab 62*a*, a mating engagement tab 62*b* and a mounting portion 62*c*. Terminal 64 is a ground terminal and has a power engagement tab 64*a*, a mating engagement tab 64*b* and a mounting portion 64*c*. Terminal 66 is a neutral terminal and has a power engagement tab 66*a*, a second terminal engagement tab 66*b* and a mounting portion 66*c*. Terminal 68 is a neutral terminal and has a first terminal engagement tab 68*a*, a mating engagement tab 68*b* and a mounting portion 68*c*. While terminals 60, 62, 64, 66, 68 are shown in the illustrative embodiment, other numbers of terminals may be used without departing from the scope of the invention.

Figure 6:
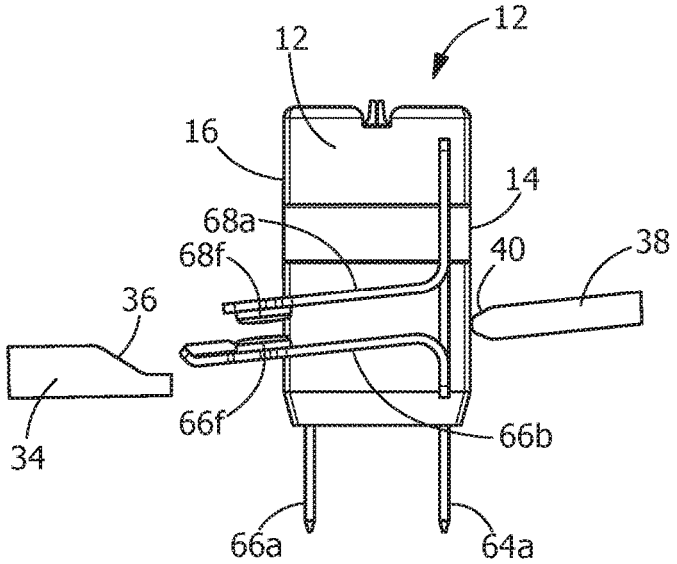
FIG. 6 is a top view of the illustrative electrical/mechanical switching module showing the contacts in an open position.
Figure 7:
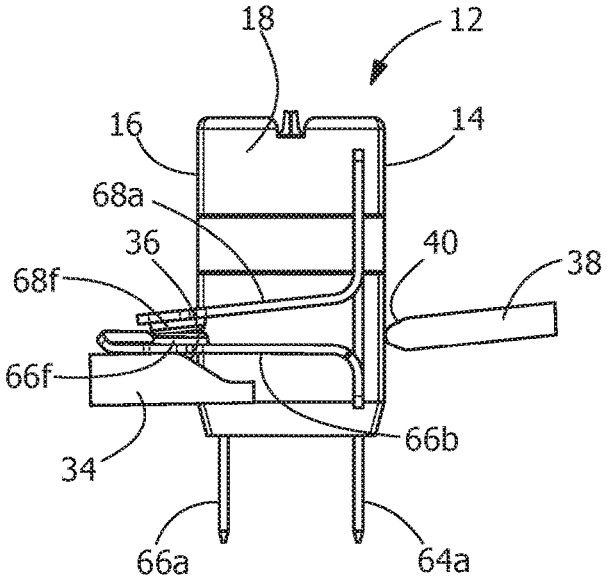
FIG. 7 is a top view of the illustrative electrical/mechanical switching module showing the contacts in a closed position, with a camming member engaging a respective contact.
Figure 8:
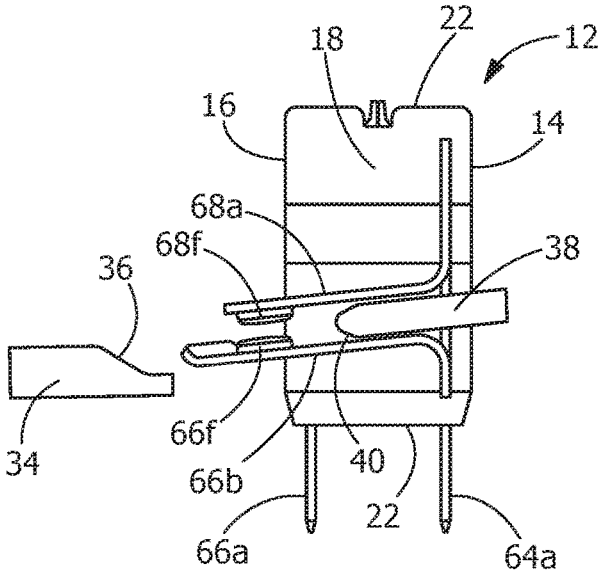
FIG. 8 is a top view of the illustrative electrical/mechanical switching module showing the contacts in an open position, with a separating projection extending between the contacts.

As best shown in FIGS. 6 through 8, terminal 66 has a copper button or dimple 66*f* attached to the second terminal engagement tab 66*b*. The copper button or dimple 66*f* has a layer of silver cold welded thereon to help prevent welding of the surface due to arcing or the like. In addition, terminal 68 has a copper button or dimple 68*f* attached to the first terminal engagement tab 68*a*. The copper button or dimple 68*f* has a layer of silver cold welded thereon to help prevent welding of the surface due to arcing or the like. The use of the silver cold welded copper dimples 66*f*, 68*f* allows the terminals 66, 68 to withstand electrical arcing at high current level, for example, but not limited to 30 amps.

The power engagement tabs 60*a*, 62*a*, 64*a*, 66*a* extend through the tab receiving openings 26 and extend beyond the side wall 22 of electrical/mechanical switching module 10. The power engagement tabs 60*a*, 62*a*, 64*a*, 66*a* are configured to engage respective contacts of a mating connector.

The engagement tabs 60*b*, 62*b*, 64*b* and 68*b* extend through tab receiving openings 24 and extend beyond the bottom wall 20 of the electrical/mechanical switching module 10. The engagement tabs 60*b*, 62*b*, 64*b* and 68*b* are configured to provide an electrical engagement with wires through contacts (not shown) or the like. Various different wires and contacts may be used to make the connection between the wire engagement tabs 60*b*, 62*b*, 64*b* and 68*b*.

The mounting portions 60*c*, 62*c*, 64*c*, 66*c* and 68*c* are positioned in the terminal receiving cavities 46. The mounting portions 60*c*, 62*c*, 64*c*, 66*c* and 68*c* may be retained in the terminal receiving cavities 46 by interference fit or other know means to mount the mounting portions 60*c*, 62*c*, 64*c*, 66*c* and 68*c*.

Figure 5:
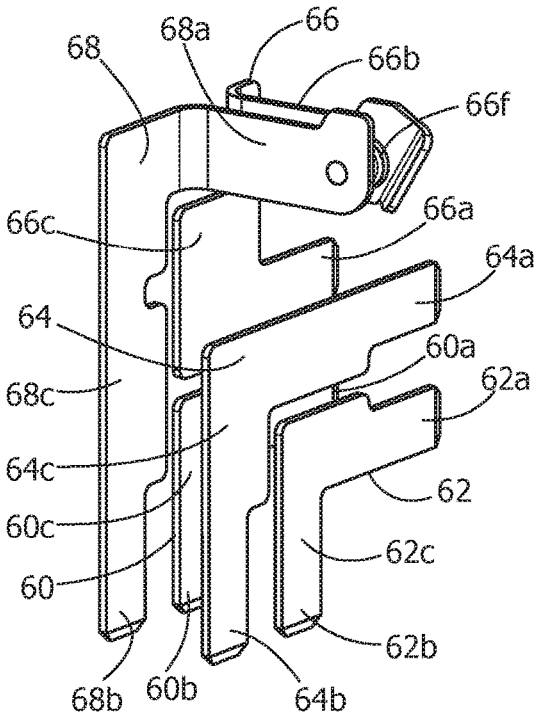
FIG. 5 is a view of the tab contacts of the illustrative electrical/mechanical switching module removed from the housing of the electrical/mechanical switching module.

As best shown in FIG. 5, terminals 66, 68 together form the neutral terminal. The terminal engagement tab 66*b* of terminal 66 and the terminal engagement tab 68*a* of terminal 68 are provided in alignment (i.e., parallel) with each other.

In operation, when a cam member 34 is in a first or open position, as shown in FIG. 6, the terminal 66 is in an unstressed position. In this position, the terminal engagement tab 66*b* is spaced from the terminal engagement tab 68*a*. With the terminal engagement tab 66*b* spaced from the terminal engagement tab 68*a*, neither a mechanical or electrical connection is made between the terminal engagement tab 66*b* and the terminal engagement tab 68*a*. Consequently, the electrical current does not flow across the terminal engagement tab 66*b* and the terminal engagement tab 68*a*.

The copper button or dimple 66*f* of the terminal engagement tab 66*b* is spaced from the copper button or dimple 68*f* of the terminal engagement tab 68*a*. With the copper button or dimple 66*f* of the terminal engagement tab 66*b* spaced from the copper button or dimple 68*f* of the terminal engagement tab 68*a*, neither a mechanical or electrical connection is made between the copper button or dimple 66*f* of the terminal engagement tab 66*b* and the copper button or dimple 68*f* of the terminal engagement tab 68*a*. Consequently, the electrical current does not flow across the copper button or dimple 66*f* of the terminal engagement tab 66*b* and the copper button or dimple 68*f* of the terminal engagement tab 68*a* and the electrical/mechanical switching module 10 is in an open position.

In the position shown in FIG. 6, the cam member 34 is provided proximate the electrical/mechanical switching module 10 in a first or open position. The cam member 34 is movable between the first or open position, as shown in FIG. 6, and a second or closed position, as shown in FIG. 7. The cam member 34 has a camming surface 36.

In the position shown in FIG. 6, an opening projection 38 is provided proximate the electrical/mechanical switching module 10 in a first position. The opening projection 38 is movable between the first position, as shown in FIG. 6, and a second position, as shown in FIG. 7. The opening projection 38 has an opening surface 40.

In the position shown in FIG. 6, neither the cam member 34 nor the opening projection 38 is provided in engagement with the terminal engagement tab 66*b* or the terminal engagement tab 68*a*

In contrast, when the cam member 34 is in the second or closed position, as shown in FIG. 7, the terminal 66 is moved to a stressed position. In this position, the camming surface 36 of the cam member 34 is moved into engagement with the terminal engagement tab 66*b* of the terminal 66, thereby moving the terminal engagement tab 66*b* of the terminal 66 to a stressed position toward the terminal engagement tab 68*a* of terminal 68. In this position, the copper button or dimple 66*f* of the terminal engagement tab 66*b* engages the copper button or dimple 68*f* of the terminal engagement tab 68*a*. The terminal engagement tab 68*a* is configured to have sufficient strength to retain the terminal engagement tab 68*a* in position as the copper button or dimple 66*f* of the terminal engagement tab 66*b* is moved into engagement therewith. With the copper button or dimple 66*f* of the terminal engagement tab 66*b* in engagement with the copper button or dimple 68*f* of the terminal engagement tab 68*a*, a mechanical and electrical connection is made between the copper button or dimple 66*f* of the terminal engagement tab 66*b* and the copper button or dimple 68*f* of the terminal engagement tab 68*a*. Consequently, the electrical current flows across the copper button or dimple 66*f* of the terminal engagement tab 66*b* and the copper button or dimple 68*f* of the terminal engagement tab 68*a*, allowing the electrical current to flow across the terminals 60, 62, 64, 66, 68 to the wires.

When the electrical/mechanical switching module 10 is returned to the open position, the cam member 34 is moved from the position shown in FIG. 7 to the position shown in FIG. 8. In addition, the opening projection 38 is moved from the first position, as shown in FIG. 7 to the second position, as shown in FIG. 8. As this occurs, the opening surface 40 and the opening projection 38 are moved between the terminal engagement tab 66*b* and the terminal engagement tab 68*a* and engages the terminal engagement tab 66*b*, facilitating the return of the terminal engagement tab 66*b* to its unstressed position, as shown in FIGS. 6 and 8.

In the position shown in FIG. 8, the terminal 66 is in an unstressed position. The copper button or dimple 66*f* of the terminal engagement tab 66*b* is spaced from the copper button or dimple 68*f* of the terminal engagement tab 68*a*. With the copper button or dimple 66*f* of the terminal engagement tab 66*b* spaced from the copper button or dimple 68*f* of the terminal engagement tab 68*a*, neither a mechanical or electrical connection is made between the copper button or dimple 66*f* of the terminal engagement tab 66*b* and the copper button or dimple 68*f* of the terminal engagement tab 68*a*. Consequently, the electrical current does not flow across the copper button or dimple 66*f* of the terminal engagement tab 66*b* and the copper button or dimple 68*f* of the terminal engagement tab 68*a*.

The use of the opening projection 38 to engage the terminal engagement tab 66*a* when the electrical/mechanical switching module 10 is in the open position provides a redundant mechanical separator to ensure that the electrical current is stopped when the electrical/mechanical switching module 10 is in the open position. The use of the opening projection 38 also provides sufficient force to cause the terminal engagement tab 66*b* to separate from the terminal engagement tab 68*a* even if arcing and welding of the terminal engagement tab 66*b* to the terminal engagement tab 68*a* has occurred.

In alternate illustrative embodiments, the terminals 66, 68 may be replaced by a mechanical switch which is integrated into the electrical receptacle connector assembly 10.

The illustrative embodiment shown eliminates the need for a separate and costly mechanical switch to be incorporated into or be provide proximate the electrical receptacle connector assembly. As the terminals of the present invention provide a mechanical switching operation, the electrical receptacle connector assembly is simplified, and the cost of the electrical receptacle connector assembly is reduced. In addition, the configuration of the camming mechanism eliminates the need for an internal spring and only allows the current to flow when the mating connector and the receptacle connector are fully mated, thereby increasing the safety of the connector assembly.

One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An electrical/mechanical switching module comprising:

a housing with a front face, a rear face, a top wall, bottom wall and side walls extend from the front face to the rear face;

terminals are provided in the housing, a first terminal of the terminals is a hot terminal and has a first terminal power engagement tab, a first terminal mating engagement tab and a first terminal mounting portion, a second terminal of the terminals is a hot terminal and has a second terminal power engagement tab, a second terminal mating engagement tab and a second terminal mounting portion, a third terminal of the terminals is a ground terminal and has a third terminal power engagement tab, a third terminal mating engagement tab and a third terminal mounting portion, a fourth terminal of the terminals is a neutral terminal and has a fourth terminal power engagement tab, a fourth terminal engagement tab and a fourth terminal mounting portion, a fifth terminal of the terminals is a neutral terminal and has a fifth terminal engagement tab, a fifth terminal mating engagement tab and a fifth terminal mounting portion.

2. The electrical/mechanical switching module as recited in claim 1, wherein four tab receiving openings extend through the bottom wall, four tab receiving openings extend through a side wall of the side walls, and two tab receiving openings extend through the top wall of the electrical/mechanical switching module.

3. The electrical/mechanical switching module as recited in claim 1, wherein the fourth terminal has a fourth terminal copper dimple attached to the fourth terminal engagement tab and the fifth terminal has a fifth terminal copper dimple attached to the fifth terminal engagement tab.

4. The electrical/mechanical switching module as recited in claim 3, wherein the fourth terminal copper dimple and the fifth terminal copper dimple have layers of silver cold welded thereon to help prevent welding of surfaces of the fourth terminal copper dimple and the fifth terminal copper dimple due to arcing at a high current level.

5. The electrical/mechanical switching module as recited in claim 1, wherein the fourth terminal and the fifth terminal together form the neutral terminal, the fourth terminal engagement tab and the fifth terminal engagement tab are provided in alignment with each other.

6. The electrical/mechanical switching module as recited in claim 1, wherein when the electrical/mechanical switching module is in an open position, the fourth terminal is in an unstressed position and the fourth terminal engagement tab is spaced from the fifth terminal engagement tab wherein neither a mechanical or electrical connection is made between the fourth terminal engagement tab and the fifth terminal engagement tab preventing electrical current from flowing across the fourth terminal engagement tab and the fifth terminal engagement tab.

7. The electrical/mechanical switching module as recited in claim 1, wherein a cam member is provided proximate the fourth terminal engagement tab of the fourth terminal, the cam member is movable between a first position and a second position.

8. The electrical/mechanical switching module as recited in claim 1, wherein an opening projection is provided proximate the fourth terminal engagement tab of the fourth terminal and the fifth terminal engagement tab of the fifth terminal, the opening projection is movable between a first position and a second position to separate the fourth terminal engagement tab and the fifth terminal engagement tab.

9. The electrical/mechanical switching module as recited in claim 1, wherein when the electrical/mechanical switching module is in a closed position, the fourth terminal is moved to a stressed position and the fourth terminal engagement tab is moved into engagement with the fifth terminal engagement tab wherein a mechanical and electrical connection is made between the fourth terminal engagement tab and the fifth terminal engagement tab allowing electrical current to flow across the fourth terminal engagement tab and the fifth terminal engagement tab.

10. An electrical/mechanical switching module comprising:

a housing having a front face, a rear face, a top wall, bottom wall and side walls extend from the front face to the rear face;

a first terminal, the first terminal being a neutral terminal and having a first terminal power engagement tab, a first terminal engagement tab and a first terminal mounting portion, the first terminal power engagement tab extending from a side wall of the side walls of the housing, the first terminal engagement tab extending from the top wall of the housing;

a second terminal, the second terminal being a neutral terminal and having a second terminal engagement tab, a second terminal mating engagement tab and a second terminal mounting portion, the second terminal engagement tab extending from the top wall of the housing, the second terminal engagement tab extending from the bottom wall of the housing;

wherein when the electrical/mechanical switching module is in an open position, the first terminal is in an unstressed position and the first terminal engagement tab is spaced from the second terminal engagement tab wherein neither a mechanical or electrical connection is made between the first terminal engagement tab and the second terminal engagement tab preventing electrical current from flowing across the first terminal engagement tab and the second terminal engagement tab;

wherein when the electrical/mechanical switching module is in a closed position, the first terminal is moved to a stressed position and the first terminal engagement tab is moved into engagement with the second terminal engagement tab wherein a mechanical and electrical connection is made between the first terminal engagement tab and the second terminal engagement tab allowing electrical current to flow across the first terminal engagement tab and the second terminal engagement tab.

11. The electrical/mechanical switching module as recited in claim 10, wherein the first terminal has a first terminal copper dimple attached to the first terminal engagement tab and the second terminal has a second terminal copper dimple attached to the second terminal engagement tab.

12. The electrical/mechanical switching module as recited in claim 11, wherein the first terminal copper dimple and the second terminal copper dimple have layers of silver cold welded thereon to help prevent welding of surfaces of the first terminal copper dimple and the second terminal copper dimple due to arcing at a high current level.

13. The electrical/mechanical switching module as recited in claim 11, wherein the first terminal engagement tab and the second terminal engagement tab are provided in alignment with each other.

14. The electrical/mechanical switching module as recited in claim 11, wherein a cam member is provided proximate the first terminal engagement tab of the first terminal, the cam member is movable between a first position and a second position.

15. The electrical/mechanical switching module as recited in claim 14, wherein an opening projection is provided proximate the first terminal engagement tab of the first terminal and the second terminal engagement tab of the second terminal, the opening projection is movable between a first position and a second position to separate the first terminal engagement tab and the second terminal engagement tab.

16. An electrical/mechanical switching module comprising:

a housing;

a first terminal provided in the housing, the first terminal having a first terminal engagement tab, the first terminal engagement tab being movable between an open position and a closed position;

a second terminal provided in the housing, the second terminal having a second terminal engagement tab;

the first terminal having a first terminal copper dimple attached to the first terminal engagement tab and the second terminal having a second terminal copper dimple attached to the second terminal engagement tab;

the first terminal copper dimple being spaced from the second terminal copper dimple copper dimple when the first terminal engagement tab is in the open position, and the first terminal copper engaging the second terminal copper dimple copper dimple when the first terminal engagement tab is in the closed position allowing electrical current to flow from the first terminal copper dimple to the second terminal copper dimple wherein when the electrical/mechanical switching module is in an open position, the first terminal is in an unstressed position and the first terminal engagement tab is spaced from the second terminal engagement tab wherein neither a mechanical or electrical connection is made between the first terminal engagement tab and the second terminal engagement tab preventing electrical current from flowing across the first terminal engagement tab and the second terminal engagement tab;

wherein when the electrical/mechanical switching module is in a closed position, the first terminal is moved to a stressed position and the first terminal engagement tab is moved into engagement with the second terminal engagement tab wherein a mechanical and electrical connection is made between the first terminal engagement tab and the second terminal engagement tab allowing electrical current to flow across the first terminal engagement tab and the second terminal engagement tab.

17. The electrical/mechanical switching module as recited in claim 16, wherein the first terminal copper dimple and the second terminal copper dimple have layers of silver cold welded thereon to help prevent welding of surfaces of the first terminal copper dimple and the second terminal copper dimple due to arcing at a high current level.

18. The electrical/mechanical switching module as recited in claim 17, wherein a cam member is provided proximate the first terminal engagement tab of the first terminal, the cam member being movable between a first position and a second position to move the first terminal engagement tab from the open position to the closed position; and an opening projection is provided proximate the first terminal engagement tab of the first terminal and the second terminal engagement tab of the second terminal, the opening projection being movable between a first position and a second position to move the first terminal engagement tab from the closed position to the open position.

19. The electrical/mechanical switching module as recited in claim 16, wherein the first terminal is a neutral terminal, the second terminal is a neutral terminal, a third terminal positioned in the housing is a hot terminal, a fourth terminal positioned in the housing is a hot terminal, and a fifth terminal positioned in the housing is a ground terminal.

20. The electrical/mechanical switching module as recited in claim 19, wherein the first terminal has a first terminal power engagement tab and the first terminal engagement tab, the second terminal has the second terminal engagement tab and a second terminal mating engagement tab, the third terminal has a third terminal power engagement tab and a third terminal mating engagement tab, the fourth terminal has a fourth terminal power engagement tab and a fourth terminal mating engagement tab, and the fifth terminal has a fifth terminal power engagement tab and a fifth terminal mating engagement tab.

* * * * *